US006173137B1

(12) United States Patent
Zona

(10) Patent No.: US 6,173,137 B1
(45) Date of Patent: Jan. 9, 2001

(54) APPARATUS FOR MAINTAINING SUBSTANTIALLY CONSTANT SPACING BETWEEN DEVELOPING DEVICE AND A PHOTOCONDUCTIVE MEMBER

(75) Inventor: Michael F. Zona, Holley, NY (US)

(73) Assignee: Xerox Corporation, Stamford, CT (US)

( * ) Notice: Under 35 U.S.C. 154(b), the term of this patent shall be extended for 0 days.

(21) Appl. No.: 09/432,397

(22) Filed: Nov. 2, 1999

(51) Int. Cl.[7] ..... G03G 21/00; G03G 15/16

(52) U.S. Cl. ..... 399/99; 399/313; 399/318; 399/343

(58) Field of Search ..... 399/91, 99, 126, 399/313, 297, 318, 343

(56) References Cited

U.S. PATENT DOCUMENTS 3,940,272 2/1976 Davidson ..... 430/126
6,044,235 * 3/2000 Hashimoto ..... 399/99

FOREIGN PATENT DOCUMENTS 58-85447 * 5/1983 (JP) .
63-183477 * 7/1988 (JP) .
4-52668 * 2/1992 (JP) .

* cited by examiner

*Primary Examiner*—Susan S. Y. Lee
(74) *Attorney, Agent, or Firm*—H. Fleischer

(57) ABSTRACT

An apparatus which cleans particles from a tracking region on a photoconductive drum. A spacer maintains the spacing between the photoconductive drum and a developer roller substantially constant. The spacer contacts the photoconductive drum in the tracking region. The cleaning member, mounted on a transfer roller, removes particles adhering to the tracking region so as to ensure that there is no build up of particles in the tracking region changing the spacing between the photoconductive drum and the developer roller.

27 Claims, 3 Drawing Sheets

APPARATUS FOR MAINTAINING SUBSTANTIALLY CONSTANT SPACING BETWEEN DEVELOPING DEVICE AND A PHOTOCONDUCTIVE MEMBER

The present invention relates generally to an apparatus for developing a latent image, and more particularly concerns cleaning particles from the photoconductive member in the region of contact with the developing device so as to maintain a substantially uniform gap between the developing device and the photoconductive member.

Generally, an electrophotographic printing machine includes a photoconductive member which is charged to a substantially uniform potential to sensitize its surface. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer material into contact therewith. This forms a visible image on the photoconductive member which is subsequently transferred to a print sheet. The latent image is developed with a developer material which may be a liquid or a powder. After development, the print sheet is heated to permanently affix the image transferred thereto to the print sheet.

Many factors influence the quality of the developed image with a powder developer material, the most significant factor being the uniformity with which the toner particles are deposited on the latent image recorded on the photoconductive surface. Magnetic brush systems are frequently used to achieve the requisite uniformity in toner disposition. The magnetic brush system achieves a high degree of uniform toner deposition, and, therefore, numerous electrophotographic printing machines utilize this type of development system. Magnetic brush systems usually include a developer roll having a directional flux field adapted to bring the developer material into contact with the charged photoconductive surface. Generally, the developer roll of the magnetic brush development system is fixed relative to the photoconductive surface. It has been found that the spacing between the photoconductive surface and the developer roll is extremely critical to the performance of the electrophotographic printing machine. This spacing has significant effects on the solid area density and background performance of the system. When the development system is part of a customer replaceable unit, the spacing is also critical and has a direct impact on the life of the customer replaceable unit. A large amount of work has been done to optimize the spacing to yield both the life requirements and the expected print quality performance. Most frequently, the spacing is controlled by a pair of tracking rollers that are mounted on each end of the developer roller. The tracking rollers contact the surface of the photoconductive member to maintain a uniform gap between the developer roller and the photoconductive surface. However, it has been found, that during operation, toner builds up on the surface of the photoconductive member in the area in which the tracking rolls contact the photoconductive member. This loosely adhered toner causes the spacing between the photoconductive member and the developer roller to increase, which reduces the solid area density and uniformity across the image.

Systems adapted to space the developer roller from the photoconductive drum are well known. The following disclosure describes a system of this type:

U.S. Pat. No. 3,940,272

Patentee: Davidson

Issued: Feb. 24, 1976

The pertinent portions of this patent may be briefly summarized as follows:

U.S. Pat. No. 3,940,272 discloses a developer unit having a housing with a developer roller. The developer roller transports a developer mix into a development zone located between the photoconductive drum and the develop roller. The electrostatic latent image recorded on the photoconductive drum is developed by contact with the moving developer mix. The charged areas of the photoconductive drum electrostatically attract the carrier granules from the developer mix. In operation, a tracking wheel mounted on the developer housing contacts, the photoconductive drum to space the developer roller therefrom.

In accordance with the present invention, there is provided an apparatus for developing a latent image recorded on an image bearing member to form a visible image thereon and transferring the visible image from the image bearing member to a support member. The apparatus includes a developing device, positioned closely adjacent to the imaging member, to develop the latent image recorded thereon forming the visible image. A spacer is operatively associated with the developing device. The spacer spaces the developing device a selected distance from the image bearing member. The spacer is in contact with the tracking region of the image bearing member. A cleaning member, positioned to contact the tracking region, removes particles adhering to the tracking region of the image bearing member.

Pursuant to another aspect of the present invention, there is provided a printing machine of the type having a latent image recorded on an image bearing member. The improvement includes a developing device, positioned closely adjacent the image bearing member to develop the latent image recorded thereon forming a visible image. A spacer is operatively associated with the developing device for spacing the developing device a selected distance from the image bearing member. The spacer is in contact with the tracking region of the image bearing member. A cleaning member, positioned to contact the tracking region, removes particles adhering to the tracking region of the image bearing member.

In still another aspect of the present invention, there is provided an apparatus for removing particles from a tracking region on an image bearing member, wherein a spacer contacts the tracking region to space a developing device a selected distance from the image bearing member. The apparatus includes a cleaning member, positioned in contact with the tracking region, for removing particles adhering to the tracking region of the image bearing member.

Another aspect of the present invention is a method of printing including recording a latent image on an image bearing member. A latent image is developed with a developing device to form a visible image on the image bearing member. The developing device is spaced from the image bearing member by a spacing device contacting a tracking region of the image bearing member. The tracking region of the image bearing member is cleaned to remove particles adhering to the tracking region of the image bearing member.

Other features of the present invention will become apparent as the following description proceeds and upon reference to the drawings, in which.

While the present invention will hereinafter be described in connection with a preferred embodiment and method of use thereof, it will be understood that it is not intended to limit the invention to that embodiment or method of use. On the contrary, it is intended to cover all alternatives, modifications, and equivalents that may be included within the spirit and scope of the invention as defined by the appended claims.

Figure 1:
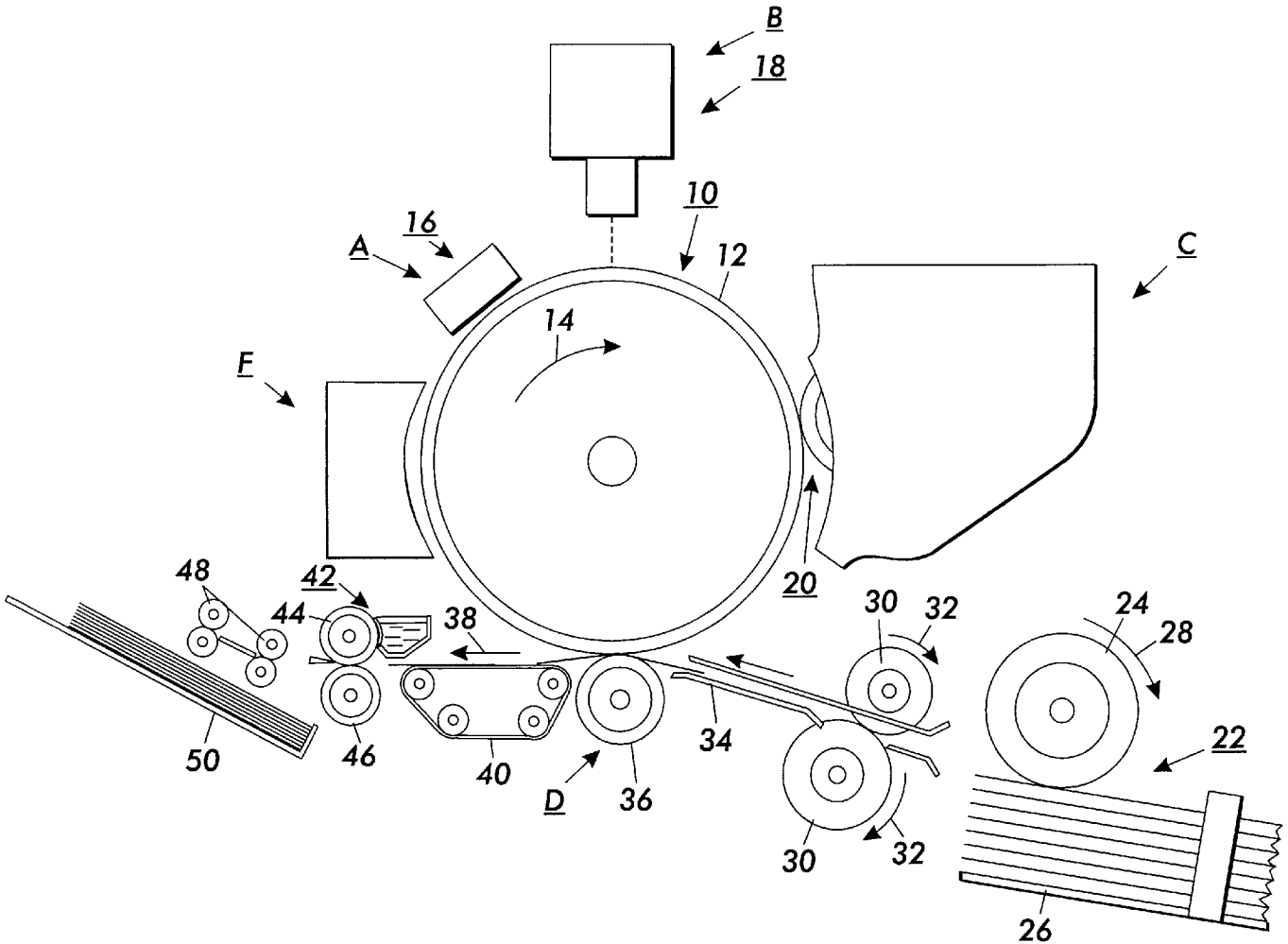
FIG. 1 is a schematic, elevational view depicting an electrophotographic printing machine incorporating the features of the presence invention therein.

For a general understanding of the features of the present invention, reference is made to the drawings. In the drawings, like reference numerals have been used throughout to designate identical elements FIG. 1 schematically depicts the various components of an illustrative electrophotographic printing machine incorporating the features of the present invention therein. It will become evident from the following discussion that the present invention is well suited for use in a wide variety of printing machines, and is not necessarily limited in its application to the particular embodiment and method of use described herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a drum 10 having a photoconductive surface 12. Preferably, photoconductive surface 12 comprises a transport layer containing a small molecule dispersed in an organic resinous material and a generation layer having a triginal selenium dispersed in a resinous material. Drum 10 moves in the direction of arrow 14 to advance successive portions of photoconductive surface 12 sequentially through the various processing stations disposed about the path of movement thereof.

Initially, a portion of photoconductive surface 12 passes through charging station A. At charging station A, a corona generating device indicated generally by the reference numeral 16, charges photoconductive surface 12 to a relative high, substantially uniform potential.

Next, the charged portion of photoconductive surface 12 is advanced through exposing station B. At the exposing station, an imaging beam generated by a raster output scanner (ROS) 18 illuminates the charged portion of the photoconductive surface. ROS 18 employs a laser with rotating polygon mirror blocks to create an electrostatic latent image on photoconductive surface 12 of drum 10. This electrostatic latent image is developed at development station C.

At development station C, a magnetic brush developer unit deposits toner particles on the electrostatic latent image. The magnetic brush developer unit includes a developer roller 20 which transports the developer mix into contact with the electrostatic latent image. The latent image attracts the toner particles from the carrier material to form a visible image on photoconductive surface 12 of drum 10. One skilled in the art will appreciate that a single component developer material may be utilized as well. When a single component developer material is used, the toner particles are magnetic. The detailed structure of the development system will be described hereinafter with reference to FIG. 2.

After development, drum 10 then advances the visible image of toner particles to transfer station D. At transfer station D, a sheet of transport material is moved into contact with the toner particles image. The sheet of support material is advanced to transfer station D by a sheet feeding apparatus indicated generally by the reference numeral 22. Preferably, sheet feeding apparatus 22 includes a feed roll 24, in contact with the uppermost sheet of a stack of sheets 26. Feed roll 24 rotates in the direction of arrow 28 so as to advance the uppermost sheet into the nip defined by forwarding rollers 30. Forwarding rollers 30 rotate in the direction of arrow 32 to advance the sheet into chute 34. Chute 34 directs the advancing sheet of support material into a nip defined by transfer roller 36 and drum 10. Transfer roller 36 is electrically biased to a potential having a magnitude and polarity sufficient to electrostatically attract the toner particles from photoconductive surface 12 to the sheet of support material. After transfer, the sheet of support material continues to move in the direction of arrow 38 onto a conveyor 40 which advances the sheet to fusing station E.

Fusing station E includes a fuser assembly, indicated generally by the reference numeral 42, which permanently affixes the transferred toner particle image to the sheet. Preferably, fuser assembly 42 includes a heated fuser roller 44 and a back-up roller 46. The sheet passes between fuser roller 44 and back-up roller 46 with the toner particle image contacting fuser roller 44. In this manner, the toner particle image is permanently affixed to the sheet. After fusing, forwarding rollers 48 advance the sheet to catch tray 50 for subsequent removal from the printing machine by the operator.

Invariably, after the sheet of support material is separated from photoconductive surface 12 of drum 10, some residual particles remain adhering thereto. These residual particles are removed from photoconductive surface 12 at cleaning station F. Cleaning station F includes a rotatably mounted fibrous brush in contact with the image area of photoconductive surface 12. The particles are cleaned from photoconductive surface 12 by the rotation of the brush in contact therewith. Subsequent to cleaning, a discharge lamp floods photoconductive surface 12 with light to dissipate any residual electrostatic charge remaining thereon prior tO the charging thereof for the next successive imaging cycle.

It is believed that the foregoing description is sufficient for purposes of the present application to illustrate the general operation of an electrophotographic machine incorporating the features of the present invention therein.

Figure 2:
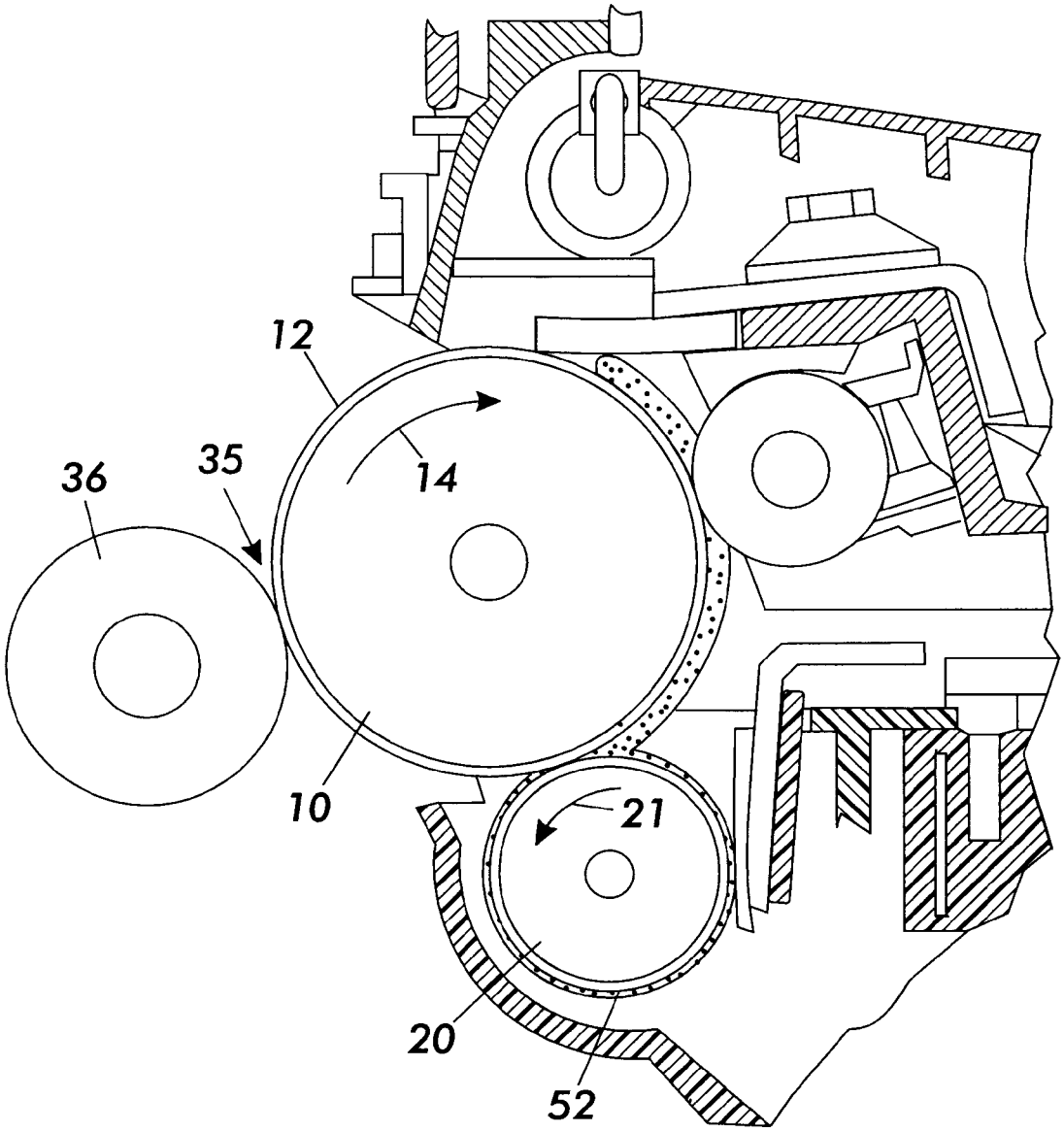
FIG. 2 is a schematic, elevational view showing the development system and transfer apparatus used in the FIG. 1 printing machine.

Referring now to the subject matter of the present invention, the detailed structure of development station C and transfer station D are depicted in FIG. 2. As shown thereat, the developer station includes a developer roller 20, rotating in the direction of arrow 21 andadapted to transport developer material into a development zone closely adjacent to the latent image recorded on photoconductive surface 12 of drum 10. A pair of tracking rollers 52 are mounted on the shaft of developer roller 20. The tracking rollers have a greater diameter than developer roller 20 and contact drum 10. Tracking rollers 52 contact drum 10 outside the region of the usable image area in a tracking region. In the tracking region where the tracking rollers 52 contact drum 10, toner builds up on the photoconductive surface. Thus, a build up of toner has been observed to exceed 0.025 mm in thickness. Inasmuch as the typical spacing between drum 10 and developer roller 20 is ±0.025 mm, the loosely adhering toner particles can cause the drum to developer roller spacing to no longer be within the required specifications. This has an adverse effect on print quality performance. Further details of the tracking rollers 52 and developer roller 20 will be discussed hereinafter with reference to FIG. 3.

With continued reference to FIG. 2, after the electrostatic latent image recorded on photoconductive surface 12 of drum 10 is developed by developer roller 20 transporting a developer material into the development zone, drum 10 advances in the direction of arrow 14 so as to move the visible toner particle image to the transfer station. At the transfer station, transfer roll 36 is positioned closely adjacent to drum 10 to define a nip 38 therebetween. Circular cleaning pads are placed on opposed ends of transfer roll 36 and mounted on the shaft thereof. These circular cleaning pads contact the tracking regions wherein tracking rollers 52 contact drum 10 to remove toner particles therefrom. This will be shown in greater detail with reference to FIG. 4.

Transfer roll 36 and drum 10 rotate at different angular velocities with the angular velocity difference ranging from about 3 to about 10 percent. This allows for a slipping action in nip 38 defined by transfer roll 36 and drum 10. This speed differential is used to eliminate a printing defect termed "hollow characters", which is found in many electrophotographic printing machines. The longitudinal length of transfer roll 36 is larger than the imaging area on photoconductive drum 10. Tracking rollers 52 contact drum 10 in those regions outside of the imaging area. Thus, the tracking region on drum 10 is spaced from the imaging area. However, the cleaning pads on transfer roll 36 are located in contact with the tracking region while being spaced from the imaging areas of drum 10.

Figure 3:
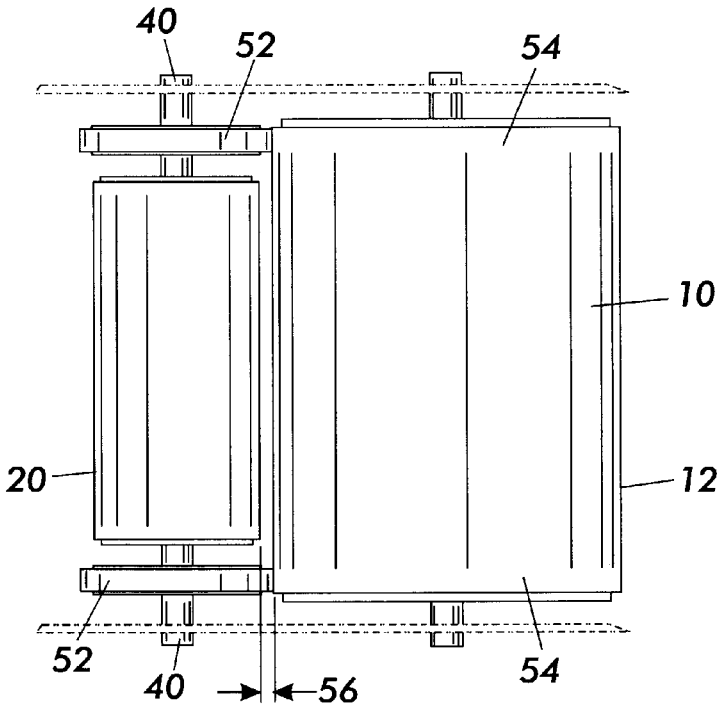
FIG. 3 is plan view showing the tracking rollers spacing the developer roller from the photoconductive drum.

Turning now to FIG. 3, there is shown the relationship between developer roller 20, drum 10, and tracking rollers 52. Developer roller 20 is mounted rotatably on shaft 40. Tracking rollers 52 are also mounted on shaft 40 and rotate with developer roller 20. One tracking roller 52 is mounted on the inboard end of shaft 40 with the other tracking roller 52 being mounted on the outboard end of shaft 40. Developer roller 20 is interposed between tracking rollers 52. The diameter of tracking rollers 52 is greater than the diameter of developer roller 20. By way of example, the diameter of tracking rollers 52 may be 0.50 mm greater than the diameter of developer roller 20. Inasmuch as tracking rollers 52 contact drum 10 in tracking region 54, developer roller 20 is spaced from drum 10 a distance indicated by reference numeral 56. The drum to roller spacing 56 is, for example, about 0.25 mm. Tracking regions 54 are located on drum 10 in opposed marginal regions thereof outside of the imaging area. Inasmuch as toner particles accumulate in tracking regions 54, the spacing between developer roller 20 and drum 10 changes. As the toner particles build up under tracking rollers 52, spacing 56 increases. This results in a degradation in print quality. Thus, it is highly desirable to be capable of removing toner particles accumulating in tracking region 54. When the toner particles are cleaned from tracking region 54, the drum to roller spacing 56 remains substantially constant, ensuring optimum print quality.

Figure 4:
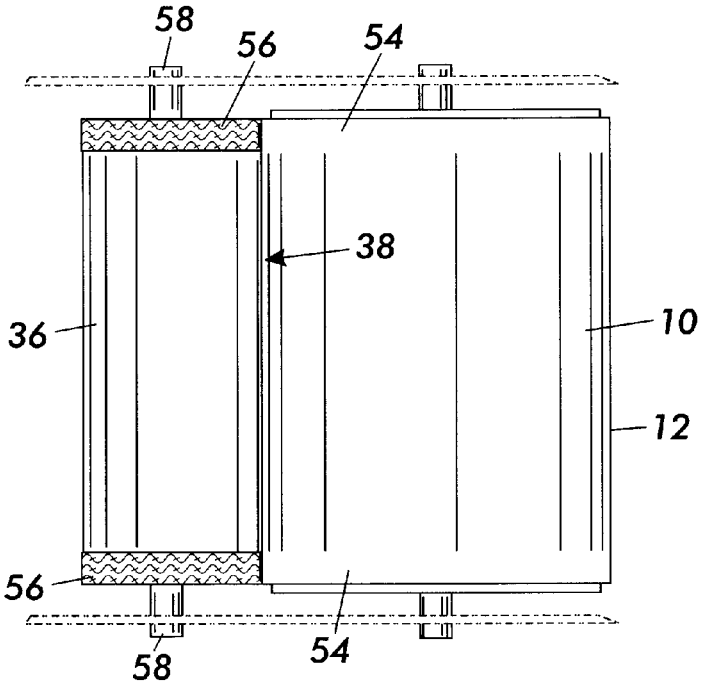
FIG. 4 is a plan view showing the transfer roll closely adjacent the photoconductive drum with cleaning pads mounted thereon to remove particles from the tracking region.

Turning now to FIG. 4, there is shown the relationship of transfer roller 36, cleaning pads 56, and drum 10 to one another. Transfer roller 36 is mounted on shaft 58. Cleaning pads 56 are also mounted on shaft 58. One cleaning pad 56 is mounted on the inboard end of shaft 58 with the other cleaning pad 56 being mounted on the outboard end of shaft 58. Transfer roller 36 is interposed between opposed cleaning pads 56. Cleaning pads 56 rotate with transfer roller 36 and contact tracking regions 54 on drum 10. Preferably, cleaning pads 56 are made from felt or urethane foam and secured to shaft 58. The cleaning pads scrub the toner particles from tracking regions 54 of drum 10. This scrubbing action occurs when the system is operative. At that time, due to the differential in angular velocity between the transfer roller 36 and drum 10, cleaning pads 56 slip or slide across tracking region 54 to enable the cleaning pads to scrub the toner particles therefrom. The cleaning performance is enhanced by the speed differential between the transfer roller 36 and drum 10. Transfer roller 36 is routinely replaced in the printing machine. Each new transfer roller 36 includes a new set of cleaning pads 58. In this way, each time the operator replaces the transfer roller, the cleaning pads are also replaced. These cleaning pads, in conjunction with the speed differential between drum 10 and transfer roller 36, enable loosely adhered toner particles to be removed from tracking regions 54 of drum 10. This ensures that there is no build up of toner particles in tracking regions 54 interfering with or changing the spacing between drum 10 and developer roller 20. This increases customer satisfaction by maintaining uniform print quality over the life of the system.

One skilled in the art will appreciate that while the printing machine of the present invention has been described as transferring toner particles to a final print sheet, an intermediate belt may also be used. In a system of that type, the visible image is transferred to the intermediate belt and subsequently transferred from the intermediate belt to the final print sheet. It should also be noted that one skilled in the art will appreciate that while the present invention has been described in conjunction with a dry developer material, a liquid developer material may also be employed by the printing machine. The cleaning apparatus of the present invention will work equally well with a liquid system or with a dry powder system.

In recapitulation, it is clear that the apparatus of the present invention optimizes print quality by ensuring that the developer roller to photoconductive drum spacing remains constant over the life of the printing machine. This is achieved by using tracking rollers contacting the photoconductive drum to space the developer roller a substantially constant distance therefrom. The tracking region where the tracking rollers contact the photoconductive drum are cleaned to remove any toner particles thereon. This prevents toner particle build up resulting in a change in a developer roller to photoconductive drum spacing. Cleaning is achieved by cleaning pads mounted on the transfer roll of the printing machine and rotating in synchronism therewith. The cleaning pads contact the tracking region and remove toner particles therefrom.

It is, therefore, evident that there has been provided in accordance with the present invention an apparatus and method of use that fully satisfies the aims and advantages hereinbefore set forth. While this invention has been described in conjunction with a specific embodiment and method of use, it is evident that many alternatives, modifications, and variations will be apparent to those skilled in the art. Accordingly, it is intended to embrace all such alternatives, modifications, and variations that fall within the spirit and broad scope of the appended claims.

What is claimed is:

1. An apparatus for developing a latent image recorded on a image bearing member to form a visible image thereon and transferring the visible image from the image bearing member to a support member, including:

a developing device, positioned closely adjacent the image being member, to develop the latent image recorded thereon forming the visible image;

a spacer, operatively associated with said developing device, for spacing said developing device a selected distance from the image bearing member, said spacer being in contact with a tracking region of the image bearing member;

a transfer device, positioned closely adjacent the image bearing member, to transfer the visible image from the image bearing member to the support member; and a cleaning member, mounted on said transfer device and positioned to contact the tracking region, to remove particles adhering to the tracking region of the image bearing member.

2. An apparatus for developing a latent image recorded on an image bearing member to form a visible image thereon and transferring the visible image from the image bearing member to a support member, including:

a developing device, positioned closely adjacent the image bearing member, to develop the latent image recorded thereon forming the visible image;

a spacer, operatively associated with said developing device for spacing said developing device a selected distance from the image bearing member, said spacer being in contact with a tracking region of the image bearing member;

a transfer device, positioned closely adjacent the image bearing member to transfer the visible image from the image bearing member to the support member; and a cleaning member, positioned to contact the tracking region, to remove particles adhering to the tracking region of the image bearing member, said cleaning member includes a cleaning pad mounted on said transfer device in contact with the image bearing member in the tracking region to remove particles therefrom so as to maintain the spacing between the image bearing member and said developing device substantially constant.

3. An apparatus according to claims 2, wherein said developing device includes a developer roller to transport developer material into a development zone closely adjacent the latent image recorded on the image bearing member to form the visible image thereon.

4. An apparatus according to claim 3, wherein said spacer includes a tracking roll, supported by said developer roller, contacting the tracking region of the image bearing member to space the developer roller therefrom.

5. An apparatus according to claim 4, wherein said transfer device includes a transfer roller, positioned adjacent the image bearing member, having said cleaning pad mounted thereon in contact with the tracking region of the imaging bearing member to remove particles therefrom.

6. An apparatus according to claim 5, wherein the image bearing member includes a drum rotating at a first angular velocity, said transfer roller rotating at a second angular velocity with the first angular velocity and the second angular velocity being different from one another so that said cleaning pad slips in the tracking region of said drum to remove particles therefrom.

7. An apparatus according to claim 6, wherein said cleaning pad includes a urethane material.

8. An apparatus according to claim 6, wherein said cleaning pad includes a felt material.

9. An apparatus according to claim 6, wherein the support member includes a final print sheet.

10. An apparatus according to claim 6, wherein the support member includes an intermediate belt.

11. A printing machine of the type having a latent image recorded on an image bearing member, wherein the improvement includes:

a developing device, positioned closely adjacent the image bearing member, to develop the latent image recorded thereon forming a visible image;

a spacer, operatively associated with said developing device, for spacing said developing device a selected distance from the image bearing member, said spacer being in contact with a tracking region of the image bearing member;

a transfer device, positioned closely adjacent the image bearing member, to transfer the visible image from the image bearing member to a support member; and a cleaning member mounted on said transfer device and, positioned to contact the tracking region, to remove particles adhering to the tracking region of the image bearing member.

12. A printing machine of the type having a latent image recorded on an image bearing member, wherein the improvement includes:

a developing device, positioned closely adjacent the image bearing member, to develop the latent image recorded thereon forming a visible image;

a spacer, operatively associated with said developing device, for spacing said developing device a selected distance from the image bearing member, said spacer being in contact with a tracking region of the image bearing member;

a transfer device, positioned closely adjacent the image bearing member, to transfer the visible image from the image bearing member to a support member; and a cleaning member, positioned to contact the tracking region, to remove particles adhering to the tracking region of the image bearing member, said cleaning member includes a cleaning pad mounted on said transfer device in contact with the image bearing member in the tracking region to remove particles therefrom so as to maintain the spacing between the image bearing member and said developing device substantially constant.

13. A printing machine according to claim 12, wherein said developing device includes a developer roller to transport developer material into a development zone closely adjacent the latent image recorded on the image bearing member to form the visible image thereon.

14. A printing machine according to claim 13, wherein said spacer includes a tracking roll, supported by said developer roller, contacting the tracking region of the image bearing member to space the developer roller therefrom.

15. A printing machine according to claim 14, wherein said transfer device includes a transfer roller, positioned adjacent the image bearing member, having said cleaning pad mounted thereon in contact with the tracking region of the image bearing member to remove particles therefrom.

16. A printing machine according to claims 15, wherein the image bearing member includes a drum rotating at a first angular velocity, said transfer roller rotating at a second angular velocity with the first angular velocity and the second angular velocity being different from one another so that said cleaning pad slips in the tracking region of said drum to remove particles therefrom.

17. A printing machine according to claim 16, wherein said cleaning pad includes a urethane material.

18. A printing machine according to claim 16, wherein said cleaning pad includes a felt material.

19. A printing machine according to claim 16, wherein the support member is a final print sheet.

20. A printing machine according to claim 16, wherein the support member is an intermediate member.

21. An apparatus for removing particles from a tracking region on an image bearing member wherein a spacer contacts the tracking region to space a developing device a selected distance from the image bearing member, including:

transfer device, positioned closely to the image bearing member to transfer a visible image developed on the image bearing member by the developing device to a member;

a cleaning member, mounted on said transfer device and positioned in contact with the tracking region, for removing particle adhering to the tracking region of the image bearing member therefrom.

22. An apparatus according to claim 21, wherein said cleaning member includes a cleaning pad mounted on said transfer device in contact with the image bearing member in the tracking region to remove particles therefrom so as to maintain the spacing between the image bearing member and the developing device substantially constant.

23. An apparatus according to claim 22, wherein:

the developing device includes a developer roller to transport developer material into a development zone closely adjacent a latent image recorded on the image bearing member to form the visible image thereon;

the spacer includes a tracking roll, supported by said developer roller, contacting the tracking region of the image bearing member to space the developer roller therefrom; and the transfer device includes a transfer roller, positioned adjacent the image bearing member, having said cleaning pad mounted thereon in contact with the tracking region of the image bearing member to remove particles therefrom.

24. An apparatus according to claim 23 wherein the image bearing member includes a drum rotating at a first angular velocity and the transfer roller rotates at a second angular velocity with the first angular velocity and the second angular velocity being different from one another so that said cleaning pad slips in the tracking region of the drum to remove particles therefrom.

25. An apparatus according to claim 24, wherein said cleaning pad includes a urethane material.

26. An apparatus according to claim 24, wherein said cleaning pad includes a felt material.

27. A method of printing, including:

recording a latent image on an image bearing member;

developing the latent image with a developing device to form a visible image on the image bearing member;

spacing the developing device from the image bearing member with a spacing device contacting a tracking region of the image bearing member;

transferring the visible image from the image bearing member to a support member with a transfer device; and cleaning the tracking region with a cleaning device mounted on the transfer device and positioned to remove particles adhering to the tracking region of the image bearing member.

* * * * *